US007488265B2

(12) United States Patent
Miller et al.

(10) Patent No.: US 7,488,265 B2
(45) Date of Patent: Feb. 10, 2009

(54) BASEBALL TRAINING DEVICE AND METHOD OF USING THE SAME

(76) Inventors: Brad Miller, 539 Fiske St., Holliston, MA (US) 01746; John Miller, 539 Fiske St., Holliston, MA (US) 01746

( * ) Notice: Subject to any disclaimer, the term of this patent is extended or adjusted under 35 U.S.C. 154(b) by 0 days.

(21) Appl. No.: 11/441,425

(22) Filed: May 24, 2006

(65) Prior Publication Data

US 2007/0202970 A1 Aug. 30, 2007

Related U.S. Application Data

(60) Provisional application No. 60/777,185, filed on Feb. 27, 2006.

(51) Int. Cl.
*A63B 69/00* (2006.01)

(52) U.S. Cl. ..... 473/452; 473/422; 473/270

(58) Field of Classification Search ..... 473/451, 473/452, 422, 270, 269, 266, 262
See application file for complete search history.

(56) References Cited

U.S. PATENT DOCUMENTS 3,352,559 A * 11/1967 Larsen ..... 473/269
3,913,951 A * 10/1975 LeFebvre, Jr. ..... 285/223
4,088,325 A * 5/1978 Sutton ..... 473/269
4,579,346 A * 4/1986 Giuntoli ..... 273/258
4,589,664 A * 5/1986 Slimp, Jr. ..... 273/258
4,694,684 A * 9/1987 Campbell, III ..... 73/65.07
4,759,542 A * 7/1988 Hudec ..... 482/34
5,328,421 A * 7/1994 Stanalajczo ..... 482/34
5,435,320 A * 7/1995 Seitz ..... 600/595
D383,510 S * 9/1997 Bernardson ..... D21/688
6,001,026 A * 12/1999 Breneman ..... 473/261
6,749,529 B1 * 6/2004 Sobolewski ..... 473/451
2005/0242538 A1 * 11/2005 Hiramatsu ..... 280/92

* cited by examiner

*Primary Examiner*—Mitra Aryanpour
(74) *Attorney, Agent, or Firm*—Kriegsman & Kriegsman

(57) ABSTRACT

A training device for throwing a baseball includes a plate assembly that is pivotally connected to a support member. The plate assembly includes a flat, rectangular balance plate and a sleeve disposed transversely across the bottom surface of the balance plate. The support member includes an elongated support arm on which the sleeve is adapted to teeter and a generally T-shaped strike plate connected to the support arm. In use, the training device can be used in the following manner to train a pitcher to exert maximum rear leg drive while throwing a baseball. Specifically, the training device is disposed on a flat, level flooring surface such that the plate assembly teeters on the support member. The pitcher then centers his rear foot on the balance plate and lifts his front knee. At this time, the pitcher drives his rear knee forward until the balance plate pivots forward and contacts the strike plate which in turn generates an audible signal. With the majority of the body weight of the pitcher displaced behind his rear knee, the pitcher begins his delivery. Because the pitcher is able to use the majority of his body weight to power his delivery, the pitcher is able to throw the baseball with greater velocity and with less strain exerted on his pitching arm.

10 Claims, 6 Drawing Sheets

BASEBALL TRAINING DEVICE AND METHOD OF USING THE SAME

CROSS-REFERENCE TO RELATED APPLICATIONS

The present application claims the benefit under 35 U.S.C. 119(e) of U.S. provisional Patent Application Ser. No. 60/777,185, filed Feb. 27, 2006, the disclosure of which is incorporated herein by reference.

BACKGROUND OF THE INVENTION

The present invention relates generally to athletic training devices and more particularly to baseball training devices.

The process of pitching a baseball typically relies on two principal steps. First, the pitcher strides his front leg forward towards the intended target. At the completion of the front leg stride, the pitcher transitions into his throwing motion (i.e., delivery), which relates to both the acceleration of the pitcher's arm forward and the ultimate release of the baseball in the direction of the intended target.

It is highly recommended that pitchers utilize proper mechanics when pitching a baseball. As can be appreciated, proper pitching mechanics serves to, among other things, (i) maximize ball velocity upon release and thereby improve performance, and (ii) minimize the stress placed on the pitcher's arm and thereby reduce the likelihood of injury.

In particular, a critical mechanical component of the pitching process relates to the ability of a pitcher to properly distribute his weight during the front leg stride. Most notably, a pitcher who is able to maximize the transfer of his body mass in the forward direction at the commencement of his delivery (i.e., forward arm motion) is able to generate more power and minimize arm strain, which is highly desirable.

A key component of proper forward weight distribution relates to the ability of a pitcher to exert the maximum possible forward drive, or push, off his rear leg as the pitcher begins his delivery. Specifically, in order to maximize rear leg drive, established pitching mechanics dictates that a pitcher initiate the front leg stride by lifting (i.e., kicking) his front knee upward so as to place the majority of the pitcher's weight on his rear leg. With the pitcher's weight properly balanced on his rear leg, proper pitching mechanics requires that the pitcher initiate his move down the mound by driving his rear knee forward. By driving his rear knee forward, the pitcher's rear hip drops which, in turn, displaces the pitcher's center of gravity (and consequently the majority of the pitcher's body mass) back behind the pitcher's rear knee. Accordingly, as the pitcher commences his front leg stride forward and in the direction of the intended target, the majority of the pitcher's mass remains as far back as possible. Once the pitcher's front foot lands, the pitcher then uses his rear leg to drive his center of gravity forward which, in turn, powers the pitcher's forward arm motion. As noted above, the ability to maximize the forward transfer of a pitcher's body weight in order to power a pitcher's delivery serves to increase ball velocity upon release and reduce arm strain, which is highly desirable.

Traditionally, pitchers rely on an instructor and/or video equipment to monitor the degree that they exhibit rear leg drive when pitching. Although useful, the aforementioned means of monitoring a pitcher's rear leg drive has been found to introduce a couple of notable drawbacks.

As an example, it has been found that the use of instructors and/or video equipment to monitor a pitcher's rear leg drive can be rather expensive in nature.

As another example, it has been found that instructors and/or video equipment are not always readily available to a pitcher.

SUMMARY OF THE INVENTION

It is an object of the present invention to provide a novel training device for throwing a baseball.

It is another object of the present invention to provide a training device as described above that is designed to train a pitcher to exert maximum rear leg drive when throwing a baseball.

It is yet another object of the present invention to provide a training device as described above that is designed to train a pitcher to exhibit a controlled sense of balance when throwing a baseball.

It is still another object of the present invention to provide a training device as described above that has a limited number of parts, is inexpensive to manufacture, is easy to use and is highly portable in nature.

Accordingly, as one feature of the present invention, there is provided a training device for throwing a baseball, said training device comprising (a) a plate assembly, and (b) a support member pivotally coupled to said plate assembly, (c) wherein said plate assembly is sized and shaped to teeter on said support member.

As another feature of the present invention, there is provided a method of training a pitcher to throw a baseball in a mechanically sound manner, said method comprising the steps of (a) providing a training device that comprises a balance plate and a support member that are pivotally coupled together, the balance plate being adapted to teeter on the support member when said training device is placed on a level flooring surface, (b) centering the rear foot of the pitcher on the balance plate, (c) lifting the front knee of the pitcher, and (d) driving the rear knee of the pitcher forward such that the balance plate pivots forward and contacts the support member.

Various other features and advantages will appear from the description to follow. In the description, reference is made to the accompanying drawings which form a part thereof, and in which is shown by way of illustration, various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Training Device (11)

Figure 1:
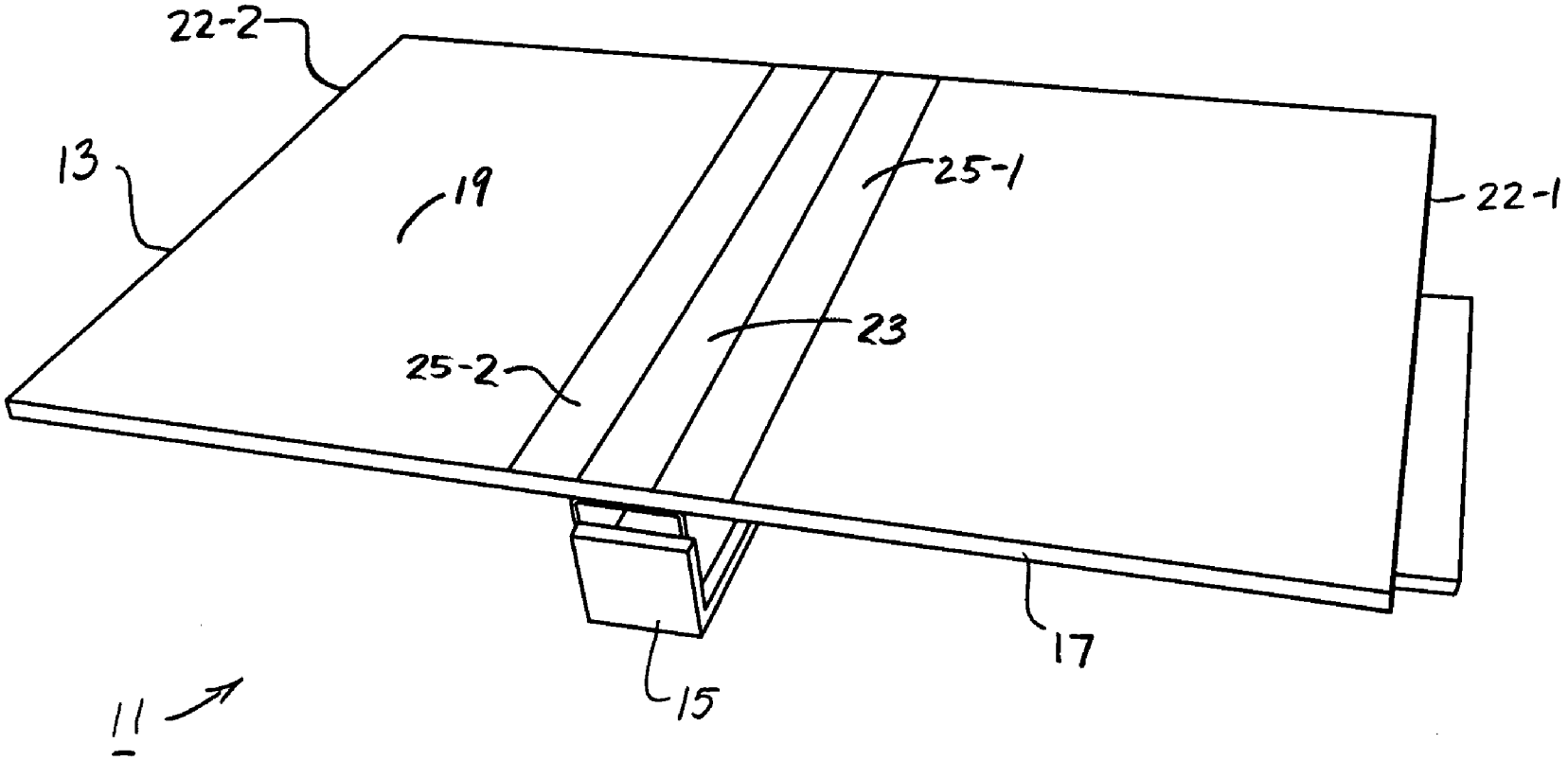
FIG. 1 is top perspective view of a training device for throwing a baseball, said training device being constructed according to the teachings of the present invention.
Figure 2:
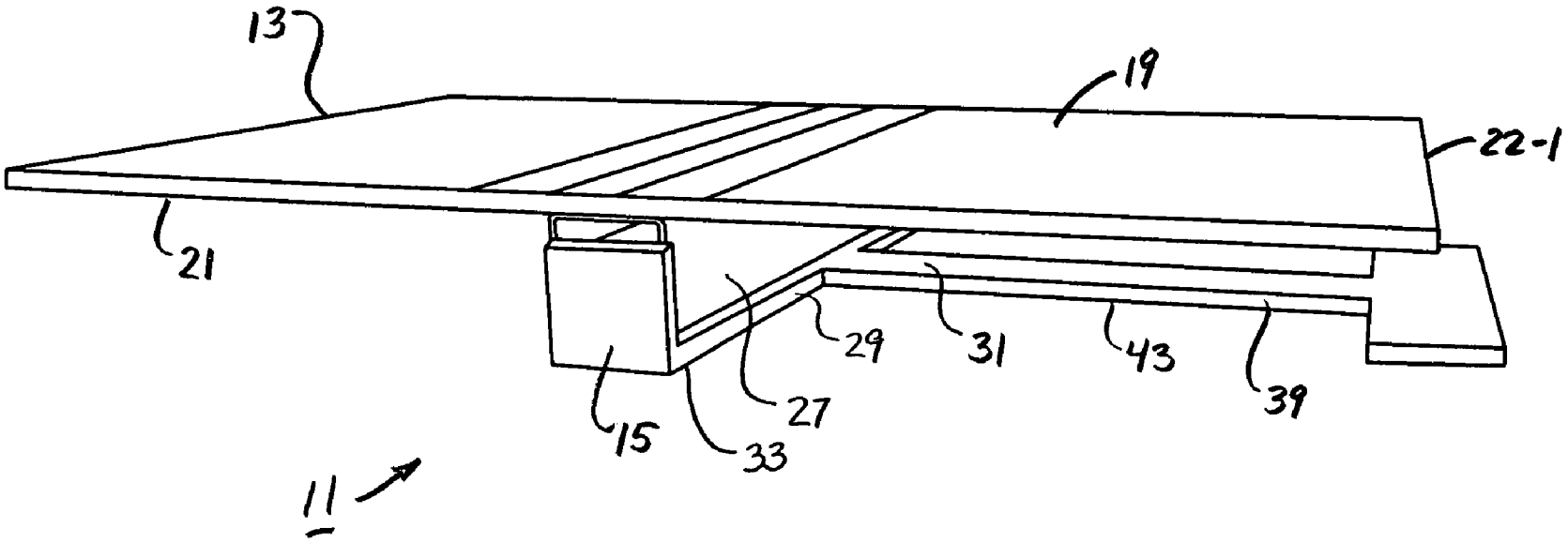
FIG. 2 is a front perspective view of the training device shown in FIG. 1.
Figure 3:
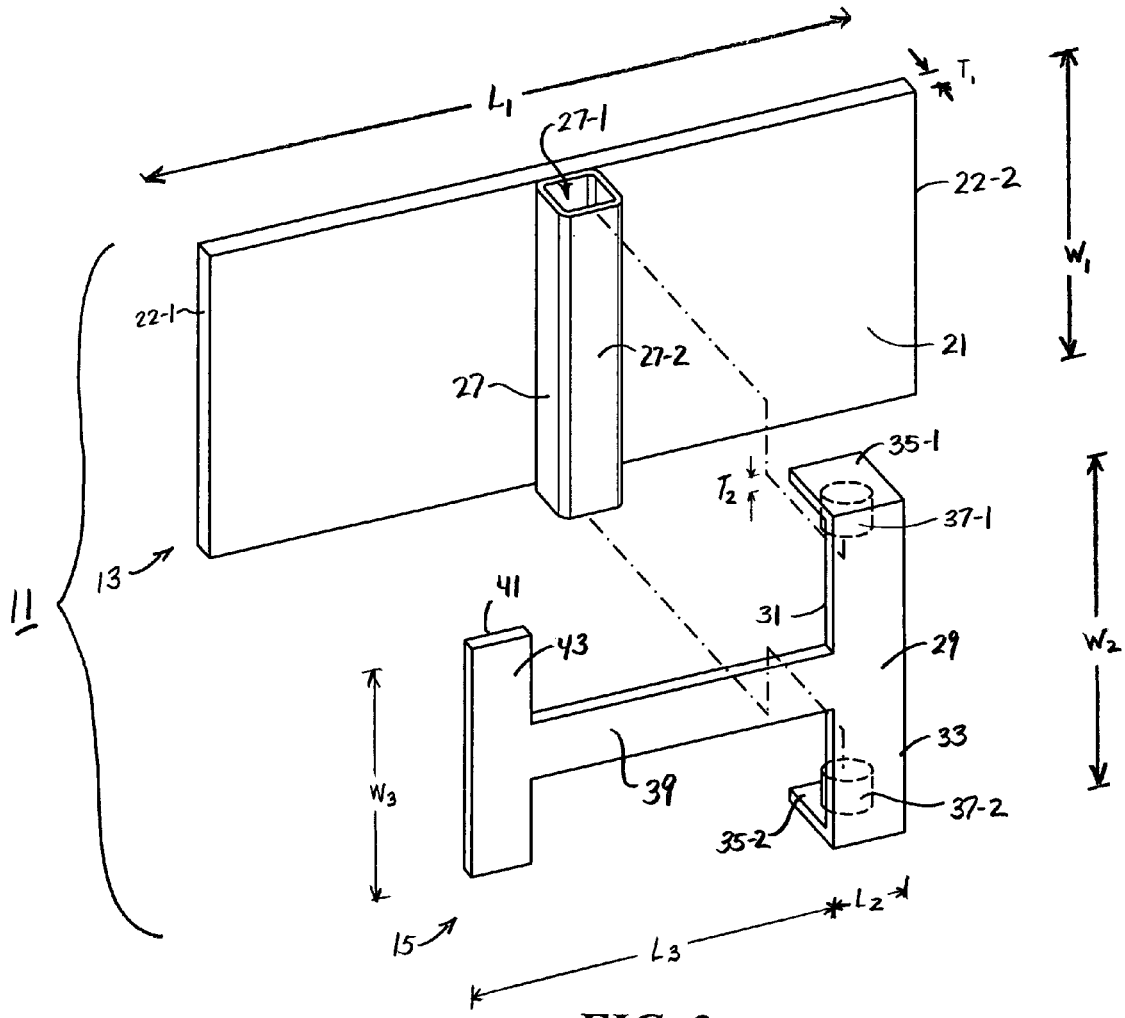
FIG. 3 is an exploded, bottom perspective view of the training device shown in FIG. 1.
Figure 4B:
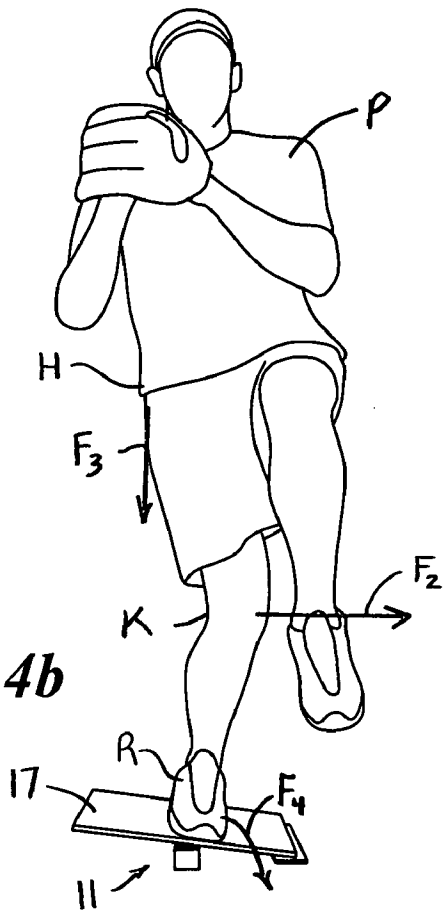
FIGS. 4(*a*)-(*e*) are front perspective views of the training device shown in FIG. 1, the training device being depicted with a pitcher balanced thereon at various stages during the process of throwing a baseball.
Figure 4A:
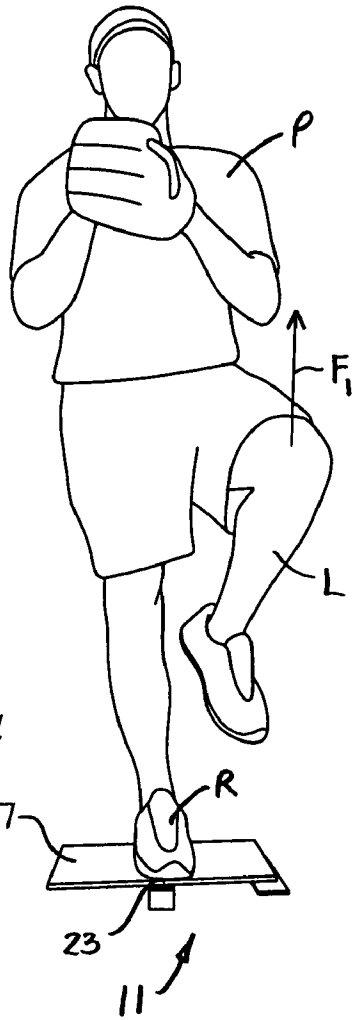
Figure 4D:
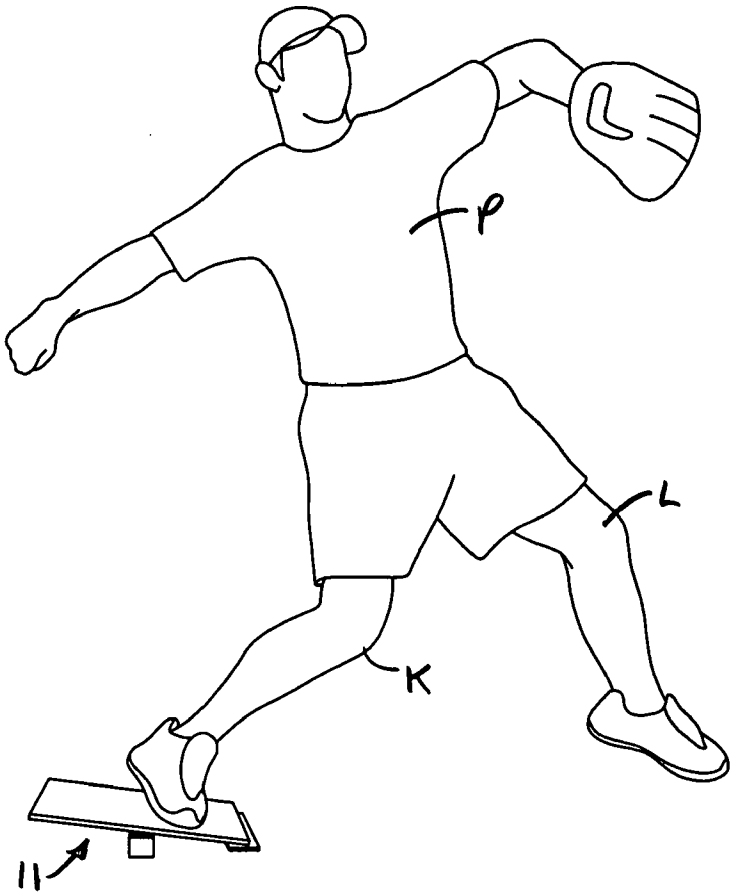
Figure 4C:
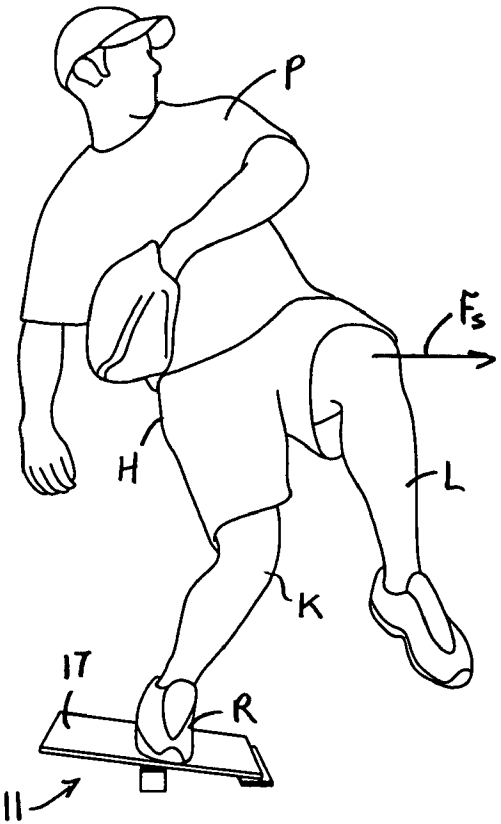
Figure 4E:
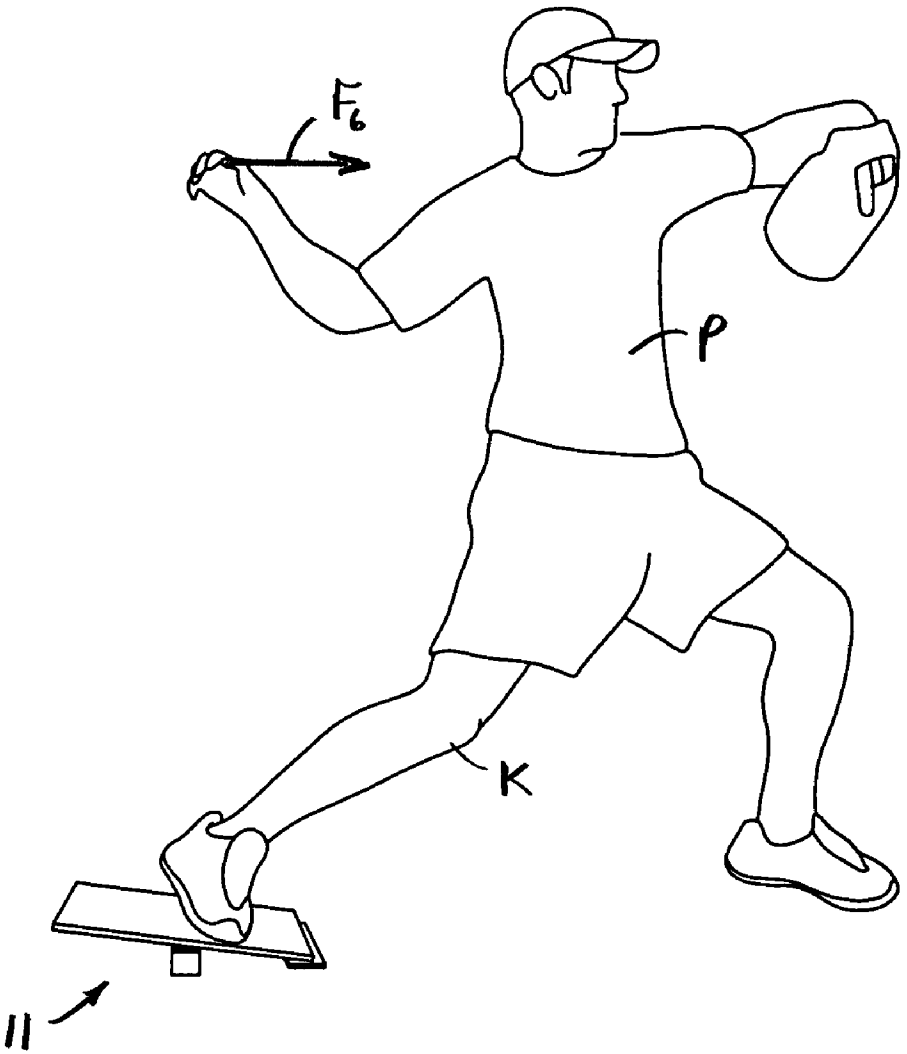

Referring now to FIGS. 1-3, there is shown a training device for throwing a baseball, said device being constructed according to the teachings of the present invention and identified generally by reference numeral 11. As will be described further in detail below, training device 11 is designed principally to both (i) promote proper balance and (ii) maximize the rear leg drive experienced by a pitcher during the process of throwing a baseball, which is highly desirable.

Training device 11 comprises a plate assembly 13 that is pivotally coupled to a support member 15. As will be described in detail below, plate assembly 13 is designed to balance, or teeter, on support member 15 when training device 11 is placed on a flat, level surface.

Plate assembly 13 comprises a balance plate 17 that is preferably constructed of a rigid and durable material, such as a lightweight aluminum, plastic or composite thereof. Balance plate 17 (also referred to herein as standing plate 17) comprises an enlarged, substantially flat top surface 19, an enlarged, substantially flat bottom surface 21, a front edge 22-1 and a rear edge 22-2.

Balance plate 17 is preferably constructed in the form of a thin, rectangular plate that has a length $L_1$ of approximately 18 inches, a width $W_1$ of approximately 12 inches and a thickness $T_1$ of approximately ¼ of an inch. However, it is to be understood that the particular shape and/or dimensions of balance plate 17 could be modified without departing from the spirit of the present invention.

As seen most clearly in FIG. 1, a center line 23 extends laterally across top surface 19 of balance plate 17 along its approximate midpoint, center line 23 having a uniform with of approximately 1 inch throughout its length. It is to be understood that center line 23 is provided on top surface 19 using paint, tape or any other suitable type of marking. As will be described further below, center line 23 serves as a marker on which the pitcher is to position his rear foot when using training device 11.

A pair of friction strips 25-1 and 25-2 are disposed on opposite sides of center line 23 in an adjacent and parallel relationship relative thereto. Each friction strip 25 is preferably in the form of an adhesive-backed length of anti-slip tape (also commonly referred to simply as safety tape in the art). As can be appreciated, friction strips 25 are provided to prevent a pitcher's rear foot from slipping on balance plate 17 during use.

As seen most clearly in FIG. 3, plate assembly 13 additionally comprises an elongated sleeve, or bracket, 27 that is connected to bottom surface 21 of standing plate 17. Preferably, sleeve 27 is constructed out of a rigid and durable material, such as metal, plastic or a composite thereof, and is permanently affixed to bottom surface 21 through a separate welding process. However, it is to be understood that standing plate 17 and sleeve 27 could be alternatively constructed as an integral piece without departing from the spirit of the present invention.

Sleeve 27 is represented herein as being in the form of an elongated bracket that is hollowed along its length so as to define an interior cavity 27-1 that is generally rectangular in lateral cross-section, sleeve 27 being additionally shaped to include a flat contact surface 27-2. As can be seen, sleeve 27 extends transversely across bottom surface 21 for the width of standing plate 17. Preferably, sleeve 27 is positioned along the center transverse line for standing plate 17. As such, sleeve 27 serves as the fulcrum, or balance point, about which standing balance plate 17 is able to teeter in either direction, as will be described further below.

As seen most clearly in FIG. 3, support member 15 is a unitary item that is constructed out of a rigid and durable material, such as a lightweight aluminum, plastic or composite thereof.

Support member, or pendulum, 15 comprises an elongated support arm 29 that includes a substantially flat top surface 31 and a substantially flat bottom surface 33. Support arm 29 is preferably constructed in the form of an elongated, flattened bar, or strip, which has a length $L_2$ of approximately 1½ inches, a width $W_2$ of approximately 12 inches and a thickness $T_2$ of approximately ¼ inches. As will be described further in detail below, top surface 31 of support arm 29 is sized and shaped to support contact surface 27-2 of sleeve 23 in such a manner so that balance plate 17 is able to teeter.

A pair of upwardly extending tabs 35-1 and 35-2 are formed onto the free ends of support arm 29, each tab 35 extending at an approximate right angle relative to top surface 31 of support arm 29.

A pair of co-axially aligned posts 37-1 and 37-2 are formed onto tabs 35-1 and 35-2, respectively, and extend inwardly towards one another. Each post 37 is constructed in the shape of a cylindrical rod that has a diameter of approximately 1 inch and a length of approximately 1 inch. It should be noted that each post 37 is sized and shaped to protrude into interior cavity 27-1 through a corresponding open end in sleeve 27. In this manner, posts 37 serve to permanently retain plate assembly 13 in a pivotally coupled relationship with support member 15.

Support member 15 additionally includes an elongated, flattened strike plate 39 that is integrally formed to and extends orthogonally away from the front edge of support arm 29. Strike plate 39 is shaped to include a substantially flat top surface 41 and a substantially flat bottom surface 43, bottom surface 43 extending in a coplanar relationship with bottom surface 33 of support arm 29.

Strike plate 39 is represented herein is having a generally T-shaped configuration with an overall length $L_3$ of approximately 9 inches and a maximum width $W_3$ (i.e., at its free end) of approximately 7 inches. However, it is to be understood that the particular shape and/or dimensions of strike plate 39 could be modified without departing from the spirit of the present invention. As will be described further below, the particular shape of strike plate 39 allows for its use as a handle in transporting training device 11, which is highly desirable.

Use of Device (11) in Training Proper Pitching Mechanics

In use, training device 11 can be used in the following manner to both promote proper balance and maximize the rear leg drive exerted by a pitcher during the process of throwing a baseball.

When use of device 11 is required (i.e., for training purposes), training device 11 is orientated with front edge 22-1 of balance plate 17 directed towards the intended target (e.g., a catcher, batter or other similar object) and with support member 15 disposed between balance plate 17 and the ground. Disposed in this manner, training device 11 is then placed upon a flat, level flooring surface with bottom surface 43 of T-shaped strike plate 39 and bottom surface 33 of support arm 29 lying directly in contact against said surface.

With training device 11 positioned as such, contact surface 27-2 of sleeve 27 rests directly upon top surface 31 of support arm 29. Based on the particular size, shape and construction of training device 11, plate assembly 13 balances, or teeters, on support arm 29 of support member 15. In the absence of any outside force applied thereto, standing plate 17 naturally biases into its horizontal, or balanced, position (i.e., in parallel with the flooring surface), as shown in FIG. 2.

Referring now to FIGS. 4(*a*)-(*e*), to commence use of training device 11, a pitcher P first disposes his rear foot R (i.e., the right foot for a right-handed pitcher) along center line, 23. Preferably, the rear foot is opened slightly for reasons to become apparent below. With rear foot R positioned as such, pitcher P commences the front leg stride portion of the pitching process (i.e., advancing the pitcher's front leg towards the batter). As seen most clearly in FIG. 4(*a*), pitcher P begins the front leg stride by lifting his front leg L directly upward, this action being typically referred to as the pitcher's leg lift or kick in the art and is represented generally by arrow $F_1$. It is important to note that proper pitching mechanics dictates that the pitcher exhibit a controlled sense of balance on his rear leg during the front leg lift.

Accordingly, it is to be understood that device 11 is specifically designed to train the pitcher to maintain the proper sense of balance at this stage during the pitching process. Specifically, if the pitcher maintains the proper sense of balance during the front leg lift, standing plate 17 will remain balanced (i.e., horizontally disposed) on support arm 29 of support member 15. To the contrary, if the pitcher exhibits any loss of stability during the front leg lift, the balance plate 17 will pivot, or teeter, accordingly. In this manner, the pitcher is provided with an immediate, tactile sense of whether the front leg lift was performed utilizing the requisite degree of balance, which is highly desirable.

It is also to be understood that device 11 is specifically designed to train the pitcher to maximize his rear leg drive during the pitching process. Specifically, referring now to FIG. 4(*b*), once the pitcher has properly completed his front leg lift, proper pitching mechanics dictates that pitcher P initiate his move down the mound by driving his rear knee K forward, said forward knee drive being represented generally by arrow $F_2$ in FIG. 4(*b*). By driving rear knee K forward, the pitcher's rear hip H drops (as represented by arrow $F_3$ in FIG. 4(*b*)) which, in turn, shifts the majority of the pitcher's body weight back behind his rear knee K. With the pitcher's rear foot R disposed slightly open, this rearward weight shift applies a significant application of pressure onto the ball of the pitcher's rear foot R. This application of pressure on the ball of the pitcher's rear foot R causes balance plate 17 to teeter forward (as represented by arrow $F_4$ in FIG. 4(*b*)) which, in turn, causes bottom surface 21 of balance plate 17 to contact T-shaped strike plate 39.

It should be noted that the pitcher's body weight causes balance plate 17 to contact strike plate 39 with a significant amount of force which, in turn, creates an substantial auditory signal (e.g., a loud metal clanking noise). As can be appreciated, this auditory signal serves to immediately notify pitcher P that his weight has been properly transferred behind rear knee K at this stage of the pitching process, which is highly desirable. To the contrary, if training device 11 does not create such a signal at this stage of the pitching process, pitcher P can immediately deduce that he exhibits a lack of initial rearward weight displacement, which is a significant mechanical pitching flaw.

With the pitcher's weight having properly positioned behind rear knee K, pitcher P commences the forward stride of front leg L, the commencement of the front leg stride being represented generally by arrow $F_5$ in FIG. 4(*c*). It is important to note that training device 11 encourages the pitcher's weight to remain behind his rear knee K as his front leg L strides forward. In fact, the pitcher's weight remains behind his rear knee K even as front leg L lands (i.e., is drawn back into contact with the mound), as seen most clearly in FIG. 4(*d*).

The landing of front leg L completes the front leg stride portion of the pitching process. Immediately thereafter, the pitcher's throwing motion (i.e., delivery) commences, said throwing motion being represented generally by arrow $F_6$ in FIG. 4(*e*). It is important to note that, because pitcher P has maintained his body weight behind rear knee K throughout the front leg stride, pitcher P can now use his rear leg to drive his body weight forward as the pitcher's throwing motion commences, which is highly desirable. In this manner, the majority of the pitcher's weight is used to accelerate his hips, torso and arm forward through the throwing motion, thereby creating a more explosive pitching delivery. Stated another way, the forward displacement of the pitcher's mass at the beginning of the throwing motion creates a kinetic chain which ultimately serves to (i) reduce stress on the pitcher's throwing arm (i.e., by using the pitcher's entire body to help generate arm speed), and (ii) improve ball velocity upon release.

When use for training device 11 is not longer required, training device 11 can be handled by grasping the free end of T-shaped striker plate 39, thereby rendering training device 11 highly portable in nature.

Use of Device (11) in Detecting Pitching Mechanics Flaws

Device 11 can be used in the manner as described in detail above to train a pitcher how to throw a baseball in a mechanically sound manner. Additionally, training device 11 can be used to detect certain mechanical flaws exhibited by a pitcher during the process of throwing a baseball. Specifically, by having a pitcher place his rear foot on center line 23 and perform his routine pitching motion, tactile and auditory signals generated by device 11 throughout said process can provide indicators of certain mechanical flaws that relate to improper weight distribution, as will be described in detail below.

As a first example, certain pitchers often exhibit a lack of significant forward weight transfer throughout the pitching process (said pitchers being referred to herein simply as "floaters"). Specifically, a floater tends to keep his body weight centralized throughout the pitching process. Accordingly, a floater typically generates all of his power with his arm (rather than in conjunction with his entire body) which (1) places undue stress on the pitcher's arm and (2) limits maximum ball velocity.

As can be appreciated, training device 11 can be used to readily detect the mechanical flaws of a floater. Specifically, because a floater never adequately transfers his weight forward, it is to be understood that standing plate 17 will remain in its balanced position (i.e., horizontally disposed) throughout the pitching process. As a result, balance plate 17 will not pivot into contact with strike plate 39 and, consequently, will not produce an auditory signal of said contact. Accordingly, a floater who completes the process of pitching a baseball without hearing any auditory signal will be instantly apprised of his lack of significant weight transfer.

As a second example, certain pitchers exhibit forward weight transfer during the pitching process but without maximizing their rear leg drive (said pitchers being referred to herein simply as "drifters"). Specifically, a drifter tends to transfer his body weight forward during the pitching process. However, a drifter fails to transfer (i.e., load) his body weight behind his right knee at the inception of the front leg stride Accordingly, a drifter derives some arm power from his body weight but is unable to truly maximize his rear leg drive because his weight was never shifted adequately backward.

As can be appreciated, training device 11 can be used to readily detect the mechanical flaws of a drifter. Specifically, because a drifter never loads his body weight behind his rear knee as his front knee kicks upward, standing plate 17 will remain in its balanced position (i.e., horizontally disposed) throughout the majority of the front leg stride. It is only as the front leg lands that the drifters body weight shifts in such a manner so as to pivot balance plate 17 against strike plate 39. Accordingly, a drifter who practices his pitching mechanics on training device 11 will hear an auditory signal only upon landing his front foot and, as such, will be instantly apprised of his weight transfer with limited rear leg drive.

Additional Design Features of Training Device (11)

Training device 11 has a number of notable design features, some of which are enumerated below.

As a first feature, training device 11 is universal in its construction and, as such, can accommodate any pitcher regardless of his/her size, weight or designated throwing arm, which is highly desirable.

As a second feature, training device 11 does not require that the pitcher actually throw a ball while practicing his/her mechanics. As a result, training device 11 can be used in a wide range of environments, which is highly desirable.

As a third feature, training device 11 is limited in size and can be easily handled by grasping the free end of strike plate 39. As a result, training device 11 is highly portable in nature, which is highly desirable.

The embodiment shown of the present invention is intended to be merely exemplary and those skilled in the art shall be able to make numerous variations and modifications to them without departing from the spirit of the present invention.

For example, it should be noted that training device 11 is not limited to a pitching application, as described in detail above. Rather, it is to be understood that training device 11 could also be used to train other types of baseball players (e.g., infielders, outfielders, catchers) how to throw a baseball with greater weight distribution without departing from the spirit of the present invention.

All such variations and modifications are intended to be within the scope of the present invention as defined in the appended claims.

What is claimed is:

1. A training device for throwing a baseball, said training device comprising:

(a) a plate assembly, the plate assembly comprising a balance plate and a sleeve, said balance plate comprising a flat top surface, a flat bottom surface, a front edge and a rear edge, and a pivot axis extending midway between said front edge and said rear edge, said sleeve being positioned under said balance plate along said pivot axis to cause said balance plate to teeter about said pivot axis, (b) a support member pivotally coupled to said plate assembly, the support member comprising a strike plate which includes a flat top surface, a flat bottom surface and a T-shaped end, (c) wherein said support member further comprises an elongated support arm pivotally coupled to the plate assembly, said support arm comprising a flattened top surface and a flattened bottom surface, wherein the top surface of said elongated support arm is sized and shaped to support the contact surface of said sleeve, (d) wherein said sleeve is hollowed along its length so as to define an interior cavity that is generally rectangular in lateral cross-section, and (e) wherein said support member further comprises:

(i) pair of upwardly extending tabs formed onto the free ends of said elongated support arm, and (ii) a pair of posts formed onto said pair of upwardly extending tabs, each post being sized and shaped to protrude into the interior cavity defined by said sleeve, (f) wherein said plate assembly is sized and shaped to teeter on said support member between a first position and a second position, the front edge of the balance plate being spaced away from the T-shaped end of the strike plate when the plate assembly is disposed in its first position and the front edge of the balance plate contacting the top surface of the T-shaped end of the strike plate when the plate assembly is disposed in its second position, and wherein a center line marking is provided on said flat top surface of said balance plate to indicate the location and orientation of a user's rear throwing foot, said center line marking extending along said pivot axis, said center line marking comprising a tape affixed to said balance plate.

2. The training device as claimed in claim 1 wherein said balance plate is constructed in the form of a thin, rectangular plate that is approximately 18 inches in length measured from said front edge to said rear edge, approximately 12 inches in width and approximately ¼ of an inch in thickness.

3. The training device as claimed in claim 1 wherein said center line marking extends along the entire length of said pivot axis.

4. The training device as claimed in claim 1 wherein the elongated support arm is constructed in the form of an elongated, flattened bar that is approximately 12 inches in length, approximately 1½ in width and approximately ¼ of an inch in thickness.

5. The training device as claimed in claim 1 wherein said sleeve is shaped to include a flattened contact surface.

6. The training device as claimed in claim 1 wherein each of said balance plate and said strike plate is constructed out of metal.

7. The training device as claimed in claim 1 wherein said center line marking has a uniform width of approximately 1 inch.

8. The training device as claimed in claim 1 wherein said plate assembly further comprises at least one friction strip disposed along side of said center line marking in an adjacent and parallel relationship relative thereto.

9. The training device as claimed in claim 1 wherein said plate assembly further comprises a pair of friction strips disposed along opposite sides of said center line marking in an adjacent and parallel relationship relative thereto.

10. A training device for throwing a baseball, said training device comprising:

(a) a plate assembly, the plate assembly comprising a balance plate and a hollow sleeve, said balance plate comprising a fiat top surface, a fiat bottom surface, a front edge, a rear edge, and a pivot axis extending midway between said front edge and said rear edge, said hollow sleeve being positioned under said balance plate along said pivot axis to cause said balance plate to teeter about said pivot axis, and (b) a support member pivotally coupled to said plate assembly, the support member comprising a strike plate which includes a fiat top surface, a fiat bottom surface and a T-shaped end, (c) wherein said support member further comprises an elongated support arm pivotally coupled to the plate assembly, and (d) wherein said support member further comprises:

(i) pair of upwardly extending tabs formed onto the free ends of said elongated support arm, and (ii) a pair of posts formed onto said pair of upwardly extending tabs, each post being sized and shaped to protrude into the interior cavity defined by said sleeve, (e) wherein said plate assembly is sized and shaped to teeter on said support member between a first position and a second position, the front edge of the balance plate being spaced away from the T-shaped end of the strike plate when the plate assembly is disposed in its first position and the front edge of the balance plate contacting the top surface of the T-shaped end of the strike plate when the plate assembly is disposed in its second position, wherein said plate assembly further comprises a center line marking comprising a tape affixed to said flat top surface of said balance plate to indicate the location and orientation of a user's rear throwing foot, said center line marking extending along said pivot axis for the entire length of said pivot axis, said center line marking having a uniform width of approximately 1 inch, and wherein said plate assembly further comprises a pair of friction strips disposed along opposite sides of the entire length of said center line marking in a parallel relationship to said center line marking and in direct contact with said center line marking.

* * * * *